US005950275A

United States Patent [19]

Wörwag

[11] Patent Number: 5,950,275

[45] Date of Patent: Sep. 14, 1999

[54] VACUUM CLEANING TOOL FOR A VACUUM CLEANING APPARATUS

[75] Inventor: Peter Wörwag, Romanshorn, Switzerland

[73] Assignee: Düpro AG, Romanshorn, Switzerland

[21] Appl. No.: 09/025,089

[22] Filed: Feb. 17, 1998

[30] Foreign Application Priority Data

Feb. 17, 1997 [DE] Germany ..... 197 06 166

[51] Int. Cl.[6] ..... A47L 5/30

[52] U.S. Cl. ..... 15/387

[58] Field of Search ..... 15/387

[56] References Cited

U.S. PATENT DOCUMENTS

| | | | |
|---|---|---|---|
| 5,088,149 | 2/1992 | Berg et al. | 15/387 X |
| 5,293,665 | 3/1994 | Worwag | 15/387 |
| 5,345,650 | 9/1994 | Downham et al. | 15/387 X |

FOREIGN PATENT DOCUMENTS

| | | |
|---|---|---|
| 3414862 | 11/1985 | Germany . |
| 4229030 | 3/1994 | Germany . |

*Primary Examiner*—Chris K. Moore
*Attorney, Agent, or Firm*—Robert W. Becker & Associates

[57] ABSTRACT

A vacuum cleaning tool having a housing that includes a connector for a vacuum hose of a vacuum cleaning apparatus is provided. Disposed in a brush chamber of the housing is a brush roller, the bristles of which project through a vacuum slot formed in the base plate of the housing. The brush roller is driven via a belt drive by an air turbine, which is provided in a turbine chamber of the housing. Provided between the brush chamber and the turbine chamber is a guide member for guiding the suction air stream that is to act upon the air turbine. In order when the vacuum cleaning tool is raised from the floor to reduce the drive power, the guide member is pivotably mounted in the housing of the tool. In a first operating pivot position the suction air stream is directed essentially tangentially against the air turbine to achieve a high drive power. In a second, non-operative pivot position the suction air stream is directed essentially radially against the turbine to achieve a low no-load speed.

7 Claims, 2 Drawing Sheets

VACUUM CLEANING TOOL FOR A VACUUM CLEANING APPARATUS

BACKGROUND OF THE INVENTION

The present invention relates to a vacuum cleaning tool that is adapted to be connected to the vacuum hose of a vacuum cleaning apparatus. A brush roller is disposed in a brush chamber of a housing, with bristles of the brush roller projecting through a vacuum slot formed in the base plate of the housing. An air turbine having blades rotatably drives the brush roller, with the air turbine being provided in a turbine chamber of the housing. Disposed between the brush chamber and the turbine chamber is a pivotable guide member for the suction air stream that is to act upon the air turbine, whereby in a first pivot position, the operating position, the suction air stream is directed essentially tangentially against the air turbine for achieving a high drive power.

A vacuum cleaning tool of this type is known from DE 42 29 030 A1. For mechanically cleaning a textile floor covering, a brush roller is disposed in the housing of the vacuum cleaning tool; the bristles of the brush roller project through a vacuum slot. The brush roller is driven via a belt drive by an air turbine, which is acted upon by the suction air stream. In so doing, the air turbine makes available an adequate drive power in order to ensure a powerful rotation of the brush roller, and hence a satisfactory cleaning, even on a long-pile floor covering.

Unfortunately, when the vacuum cleaning tool is raised from the surface of the floor that is to be cleaned, the danger exists that the user might reach into the rotating brush roller, which under unfavorable conditions can lead to injuries. A slowing down or shutting off of the drive of the brush roller is therefore provided in case the vacuum cleaning tool is raised from the floor. For example, when the tool is raised from the floor a bypass opening can be opened, as a result of which the suction air stream that is directed through the guide member upon the air turbine is reduced. During operation, a sealed closing off of the bypass air opening must be ensured so that the working power of the brush roller is not reduced in an uncontrolled manner due to an uncontrolled bypass air stream.

If to reduce the turbine power in a no-load state of the vacuum cleaning tool the connector is closed off by a cap, the driving suction air stream is interrupted; however, in so doing a considerable increase in noise of the vacuum cleaning tool must be tolerated. The forces required with an operating cleaning apparatus for opening the cap are, due to the high vacuum, considerable, so that such an arrangement must be embodied in such a way as to withstand high mechanical loads.

It is therefore an object of the present invention to improve a vacuum cleaning tool of the aforementioned general type so that the drive power of the turbine can be reduced with straightforward means when the vacuum cleaning tool is raised from the floor.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The vacuum cleaning tool of the present invention is characterized primarily in that the guide member has a second, non-operative pivot position in which it shifts the direction of the suction air stream toward the center of the air turbine for an essentially radial approach of the blades of the air turbine.

The forces necessary for moving the guide member are low; a cross-sectional area of the flow path itself is not altered. The other approach of the air turbine that is established in the non-operative position of the vacuum cleaning tool leads directly to the desired reduction in power, so that danger of injury due to the brush roller is reduced. In addition, it has been established that due to the altered essentially radial approach of the turbine, the no-load speed is reduced by about 50%, as a result of which the noise developed by the inventive vacuum cleaning tool in the non-operative position is significantly reduced.

In the first pivot position of the guide member, which corresponds to the operating position, the air turbine is preferably approached essentially tangentially, while in the second pivot position of the guide member, which corresponds to the non-operative position, the approach is essentially radial.

The guide member is preferably movable about a pivot axis that is disposed parallel to the axis of rotation of the air turbine, whereby in particular the guide member is pivotably mounted in the partition between the brush chamber and the turbine chamber in the manner of a spherical segment.

Further specific features of the present invention will be described in detail subsequently.

DESCRIPTION OF PREFERRED EMBODIMENTS

Figure 1:
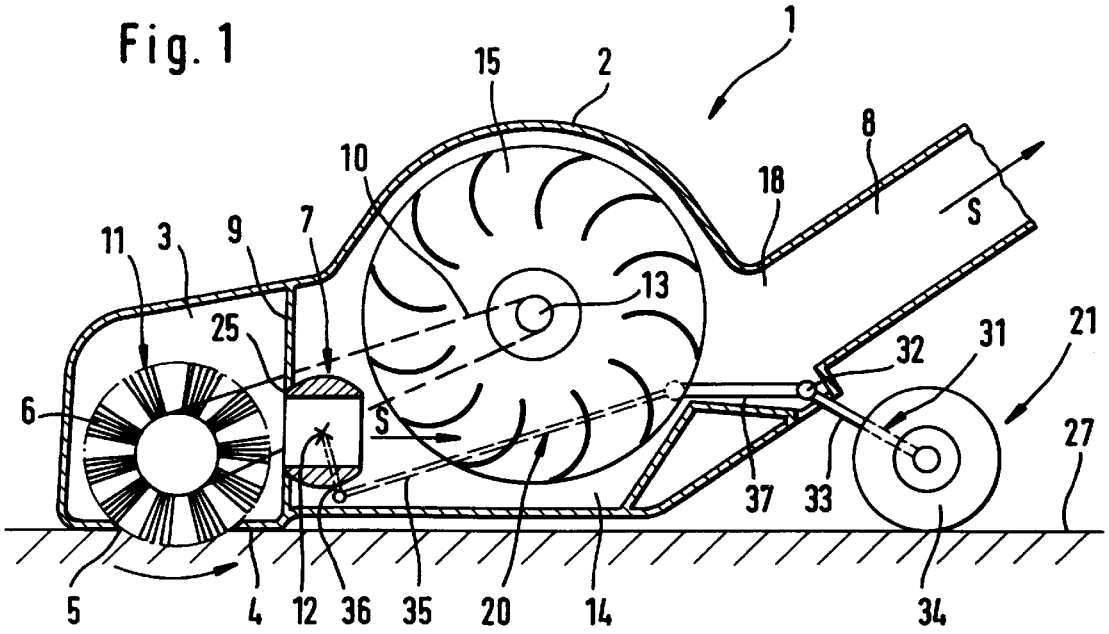
FIG. 1 is a cross-sectional view through one exemplary embodiment of the inventive vacuum cleaning tool with a pivotable guide member in the operating position.
Figure 2:
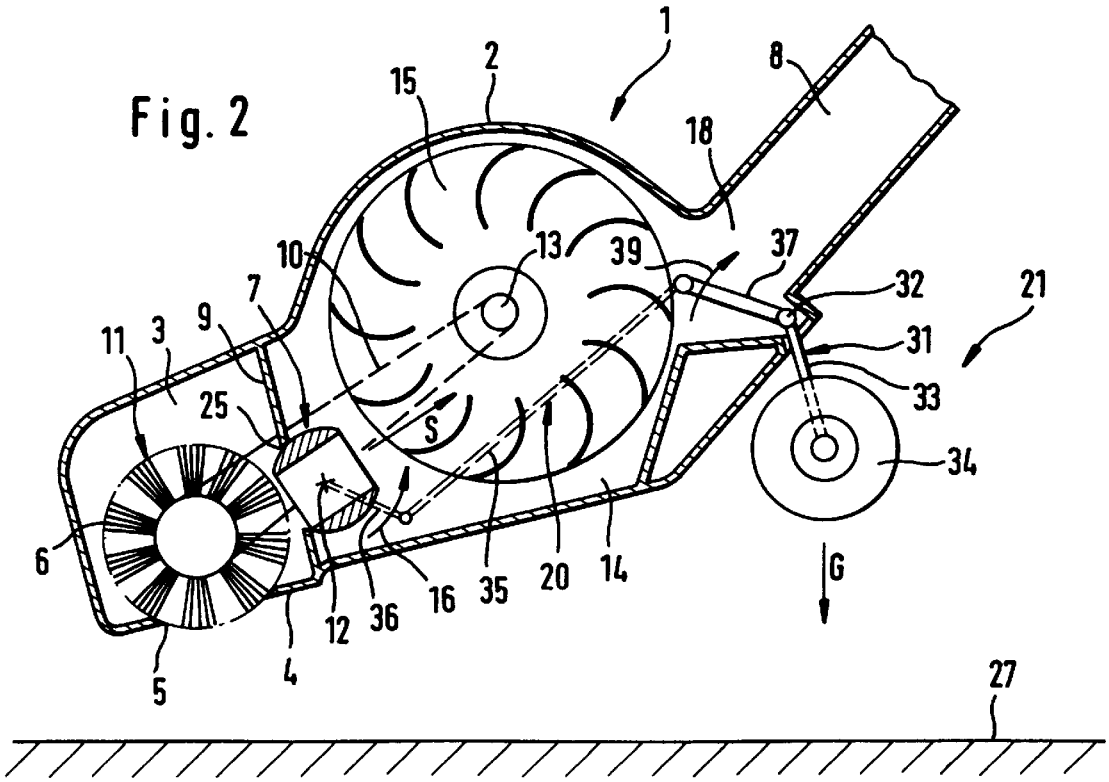
FIG. 2 shows the vacuum cleaning tool of FIG. 1 in a position where it is raised from the floor, and with the pivotably guide member in a non-operating position.

Referring now to the drawings in detail, the vacuum cleaning tool 1 illustrated in FIGS. 1 and 2 comprises a housing 2 that at one end, the rear end, is provided with a connector 8 for the vacuum hose of a vacuum cleaning apparatus. At that end of the housing 2 that faces away from the connector 8, the front end, there is formed in the housing a brush chamber 3 in which is rotatably mounted a brush roller 11 that extends over the entire working width of the vacuum cleaning tool 1. The brush roller 11 is disposed above a vacuum slot 5 that is formed in the base plate 4 of the housing 2. The bristles 6 of the brush roller 11 extend partially through the vacuum slot 5.

The brush roller 11 is driven by an air turbine 15 that is provided in a turbine chamber 14. The turbine chamber is disposed between an exit or discharge opening 18 that opens into the connector 8, and the brush chamber 3. By means of a schematically indicated belt drive 10, the brush roller 11 is driven by the air turbine 15, which is driven by the suction stream S. For this purpose, a guide member or nozzle 7 is held in the partition 9 between the brush chamber 3 and the turbine chamber 14. In the operating position illustrated in FIG. 1, in order to achieve a high drive power of the air turbine 15, the guide member 7 approaches the air turbine 15 essentially tangentially. The guide member 7 is movable about a pivot axis 12 that is disposed essentially parallel to the axis of rotation 13 of the air turbine 15. In order to ensure the seating of the pivotable guide member 7 in the partition 9 that is as sealed as possible, it is provided to set the guide member 7 in an appropriately shaped aperture 25 of the partition 9 in the manner of a spherical segment.

The guide member 7 can be adjusted by a lever arrangement 20 from a control member 21 that is disposed outside the housing 2. The control member 21 is expediently a sensing element, and in the illustrated embodiment is a contact roller 34 that is disposed at one end of an approximately L-shaped lever 31. The lever 31 is pivotably held approximately in its middle in a journal or support means 32 that is fixed to the housing. The one lever arm 33 of the lever 31 extends out of the housing 2 and carries the contact roller 34, while the other lever arm 37 is pivotably connected at its free end to a connecting rod 35. The other end of the connecting rod 35 is pivotably connected with an adjustment lever 36, which in turn is fixedly secured to a pivot shaft 38 of the guide member 7; this pivot shaft is rotatably held in non-illustrated journal or support means of the partition 9. The pivot shaft 38 (FIG. 3) forms the pivot axis 12 of the guide member 7.

If, as illustrated in FIG. 2, the vacuum cleaning tool 1 is raised from the floor 27, the contact roller 34 automatically pivots about the fixed support means 32 due to the force of gravity, which acts in the direction of the arrow G, or under the effect of an appropriately disposed and designed spring; as a consequence of this pivoting of the contact roller 34, the inner lever arm 37 pivots in the direction of the arrow 39. In so doing, the connecting rod 35 is taken along in the direction of the arrow 39, so that the adjustment lever 36 is pivoted in the direction of the arrow 16. The suction stream S that exits the guide member 7 is displaced toward the middle of the air turbine 15 and strikes the blades of air turbine 15 essentially radially, as a result of which an only low no-low speed and low drive power is obtained. The danger of injury from the brush roller 11 is low due to the greatly reduced drive power of the air turbine 15.

If the vacuum cleaning tool 1 is placed upon the floor 27, as illustrated in FIG. 1, the contact roller 34 pivots counter to the direction of the arrow 39, so that by means of the connecting rod 34 a thrust is exerted upon the adjustment lever 36 and the guide member 7 is returned to the operating position illustrated in FIG. 1. In this operating position, the guide member 7 conveys the suction stream S essentially tangentially to the air turbine 15, as a result of which a high drive power is made available for the brush roller 11.

It has been shown in practice that the pivoting of the guide member 7, and the thereby resulting change in direction of the suction stream S that drives the air turbine 15 to the center of the turbine, also involves a reduction in noise, because the no-low speed of the non loaded air turbine in view of the essentially radially supplied suction stream is significantly lower than with a tangential supply, as illustrated in FIG. 1.

Figure 3:
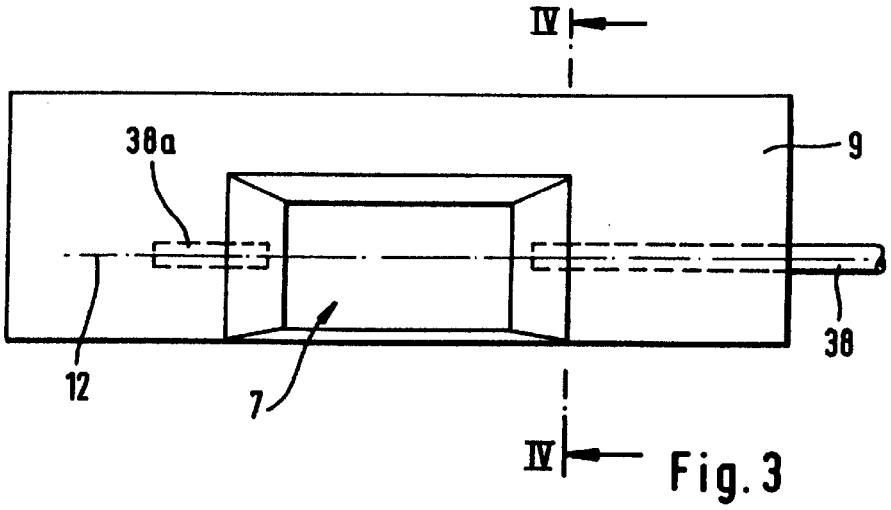
FIG. 3 is a schematic view of the guide member pivotable mounted in a wall of the housing.
Figure 4:
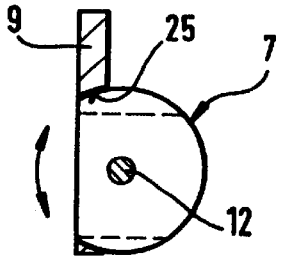
FIG. 4 is a cross-sectional view taken along the line IV—IV in FIG. 3.

The guide member 7 preferably has a partially cylindrically shaped outer contour, as can be seen in FIG. 4. The outer cylinder of the guide member 7 that is formed has the same axis as does the pivot shaft 38, whereby the pivot shaft 38 or 38*a* is respectively fixedly connected to the end faces of the cylindrical guide member 7 (FIG. 3). In this connection, merely a journal stub 38*a* is disposed at one end face. As shown in FIG. 4, the cylindrical main body of the guide member 7 is set in a corresponding cylindrically rounded aperture 25 of the partition 9.

Figure 5:
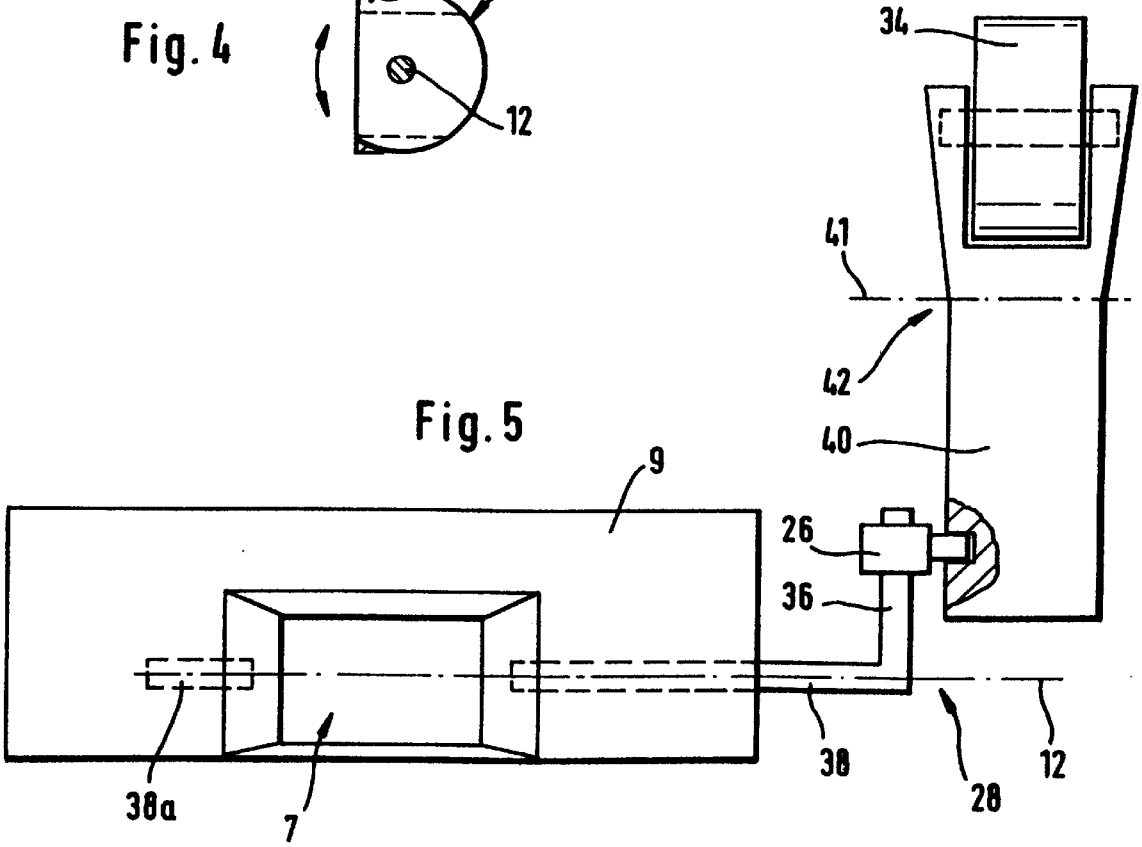
FIG. 5 is a schematic view showing the working principle of the movement of the guide member via a contact roller.

In the specific embodiment that is schematically illustrated in FIG. 5, the guide member 7 is pivotably held in the partition 9 in a manner corresponding to that illustrated in FIG. 3. The free end 28 of the pivot shaft 38 is angled off and forms the adjustment lever 36, the free end of which carries a cam follower 26. This cam follower engages in a swivel arm 40, which in turn is movable about a pivot shaft 41 that is fixed to the housing. That end of the swivel arm 40 that faces away from the cam follower 26 projects out of the housing 2 of the vacuum cleaning tool; the end 42 is preferably fork-shaped, holding a contact roller 32 between the fork ends. The function of the schematic arrangement of FIG. 5 corresponds to that described in conjunction with FIGS. 1 and 2. The pivot movement of the guide member 7 is such that the driven suction stream S is adjusted from its tangential position in the operating position (FIG. 1) in a direction toward the axis of rotation 13 of the air turbine 15, in other words in a direction towards its center, so that in the non-operative position (FIG. 2), an essential radial approach to the air turbine results.

The specification incorporates by reference the disclosure of German priority document 197 06 166.4 of Feb. 17, 1997.

The present invention is, of course, in no way restricted to the specific disclosure of the specification and drawings, but also encompasses any modifications within the scope of the appended claims.

I claim:

1. A vacuum cleaning tool comprising:

a housing that includes a connector for a vacuum hose of a vacuum cleaning apparatus;

a brush roller disposed in a brush chamber of said housing , said brush roller having bristles that project through a vacuum slot formed in a base plate of said housing;

an airturbine, with blades, disposed in a turbine chamber of said housing for rotatably driving said brush roller; and a pivotable guide member that is disposed between said brush chamber and said turbine chamber for a suction air stream that is to act upon said air turbine, wherein in a first, operating pivot position said guide member directs said suction air stream essentially tangentially against said air turbine for achieving a high drive power, and wherein in a second, non-operative pivot position said guide member shifts the direction of said suction air stream toward the center of said air turbine for an essentially radial approach of said blades of said air turbine.

2. A vacuum cleaning tool according to claim 1, wherein said guide member is movable about a pivot axis that is disposed parallel to an axis of rotation of said air turbine.

3. A vacuum cleaning tool according to claim 1, wherein said guide member is pivotably held in a partition between said brush chamber and said turbine chamber in the manner of a spherical segment.

4. A vacuum cleaning tool according to claim 3, which includes a control member disposed externally of said housing for moving said guide member.

5. A vacuum cleaning tool according to claim 4, wherein said control member is a contact element that in said first, operating position rests upon a floor that is to be cleaned.

6. A vacuum cleaning tool according to claim 5, wherein said contact element is a contact roller that is adapted to support said housing upon said floor.

7. A vacuum cleaning tool according to claim 5, wherein said control member is pivotable about a journal or support means that is fixed to said housing, and which includes a lever arrangement that is operatively connected to said control member and said guide member to effect movement of said guide member by said control member.

* * * * *